US005677656A

United States Patent [19]

Mauch et al.

[11] Patent Number: 5,677,656

[45] Date of Patent: Oct. 14, 1997

[54] ENGAGING RELAY FOR STARTER DEVICES

[75] Inventors: Fritz Mauch, Vaihingen/Enz; Karlheinz Boegner, Neuhausen/Filder; Martin Mayer, Sersheim, all of Germany

[73] Assignee: Robert Bosch GmbH, Stuttgart, Germany

[21] Appl. No.: 481,439

[22] Filed: Jun. 19, 1995

[30] Foreign Application Priority Data

Dec. 18, 1992 [DE] Germany ..... 42 42 839.7

[51] Int. Cl.[6] ..... H01H 67/02

[52] U.S. Cl. ..... 335/126; 335/131

[58] Field of Search ..... 335/126, 131

[56] References Cited

U.S. PATENT DOCUMENTS 4,801,909 1/1989 Fasola ..... 335/126
4,987,396 1/1991 Boegner .
5,175,524 12/1992 Gotoh ..... 335/126
5,227,751 7/1993 Shiroyama et al. ..... 335/131
5,291,170 3/1994 Wahba et al. ..... 335/246

FOREIGN PATENT DOCUMENTS 3737430 4/1987 Germany .

*Primary Examiner*—Lincoln Donovan
*Attorney, Agent, or Firm*—Michael J. Striker

[57] ABSTRACT

An engaging relay for starter devices of internal combustion engines as a pull-in winding of which is to be switched on via an auxiliary relay. It is provided for the purpose of a space saving, cost effective arrangement and design of the auxiliary relay that the auxiliary relay is arranged in the contact space of the engaging relay. One end of its relay winding is electrically connected in this case to the magnet core, which conducts frame potential, of the engaging relay, and the other end is electrically connected to a connecting part fastened in the switch cover of the engaging relay. A starter switch for the internal combustion engine is to be connected to this connecting part, which is constructed as a terminal, in order to switch on the engaging relay via the auxiliary relay integrated in it.

11 Claims, 6 Drawing Sheets

FIG. 2
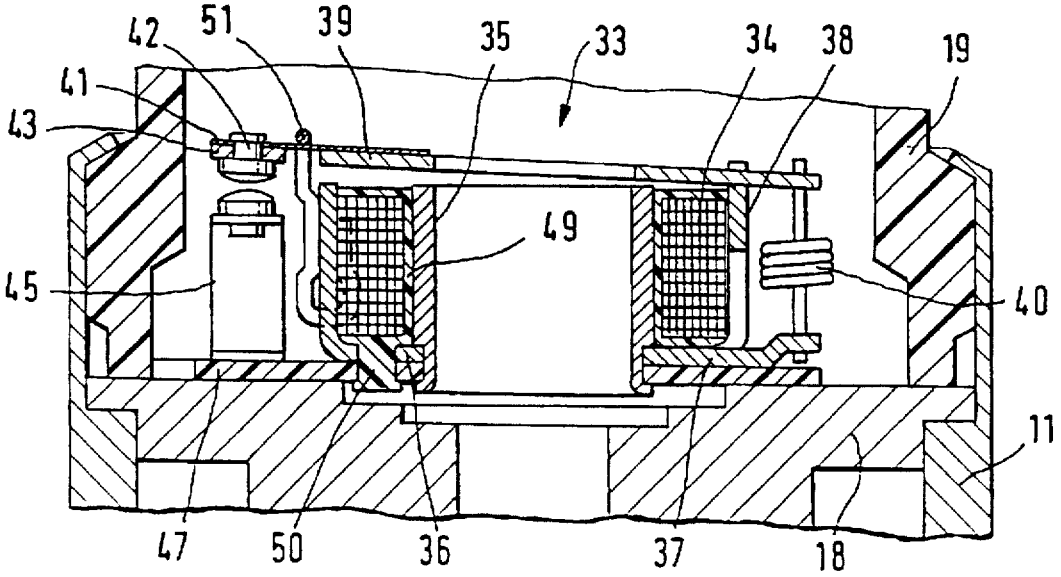
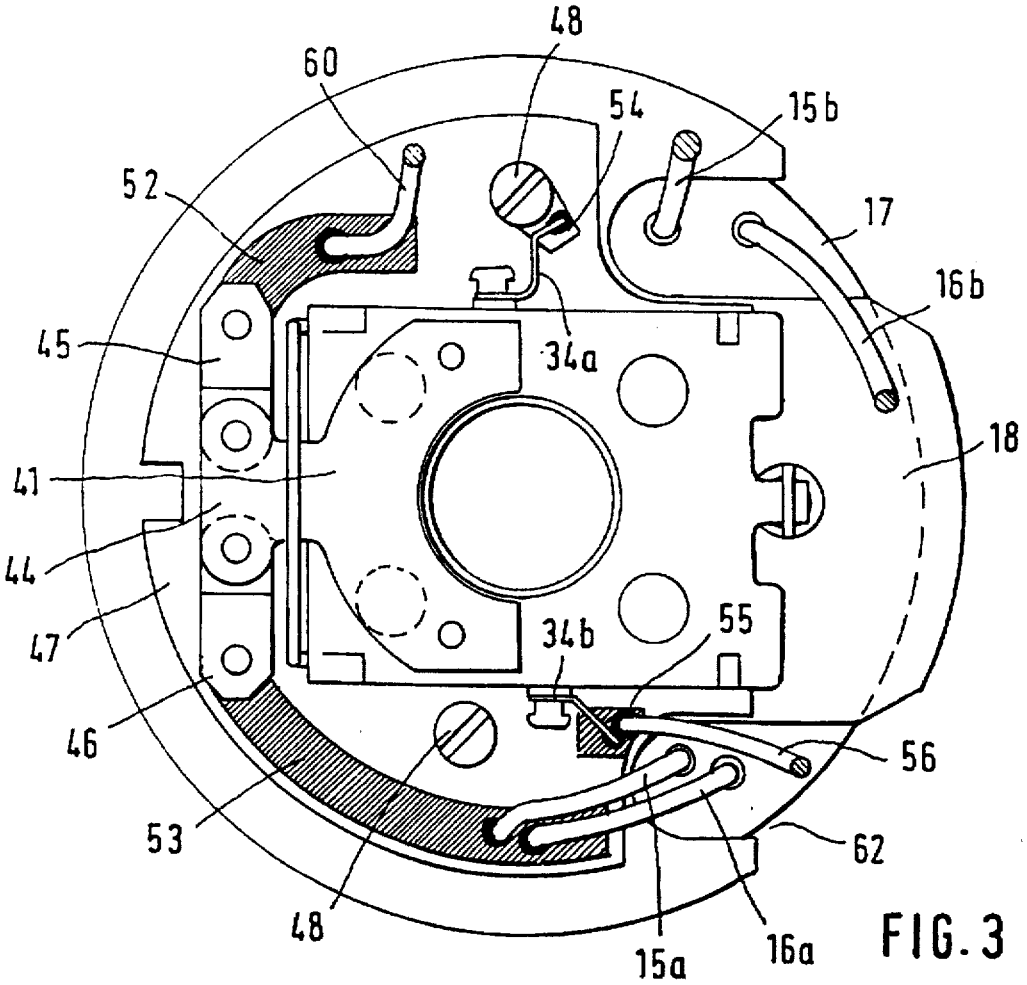
FIG. 3

ENGAGING RELAY FOR STARTER DEVICES

BACKGROUND OF THE INVENTION

The present invention relates to an engaging relay for starter devices.

More particularly, it relates to an engaging relay for starter devices for internal combustion engines, in which by switching on a pull-in winding and a holding winding of the engaging relay an armature, on the one hand engages, a pinion of the starter device in a gear ring of the internal combustion engine, and on the other hand switches on the main circuit of the starter motor of the starter device. Such engaging relay has already been disclosed per se in DE-A-37 37 430.

In commercial vehicles whose starter device is provided with an engaging pinion which is twisted via a claw-shaped lever member in a manner known per se by an engaging relay in accordance with U.S. Pat. No. 4,987,396 upon engaging in the gear ring of the internal combustion engine via spur toothing, the power requirement for the holding and pull-in winding of the engaging relay is so large that an additional relay is required to switch this current. Such an auxiliary relay, arranged separately from the starter device, for switching on the pull-in and holding winding of the engaging relay is disclosed, for example, in DE-A-37 37 430. An additional installation space is required in the vehicle for this auxiliary relay. Furthermore, additional connections are required to this auxiliary relay, in order to insert it in the starter circuit in such a way that upon actuation of the starter switch the exciter winding of the auxiliary relay is firstly switched on in order subsequently, when the relay contacts of this auxiliary relay are closed, to connect the windings of the engaging relay directly to the positive terminal 30 of the vehicle battery, with the result that the current of the engaging relay does not flow through the starter switch.

FR-A-2 626 624 discloses an engaging relay for starter devices on internal combustion engines, which also includes a contactor which switches the main current for the starter motor on and off. This contactor serves the purpose of delaying the switching on of the starter motor and must therefore have substantially larger dimensions than the auxiliary relay for switching on the pull-in and holding windings of the engaging relay. Consequently, such a contactor requires additional space even if it is combined spatially with the engaging relay.

The aim of the present solution is to keep as low as possible the space requirement and the outlay on circuitry for the auxiliary relay, in order to achieve a cost effective solution.

ADVANTAGES OF THE INVENTION

By contrast with the abovementioned known engaging relay, the engaging relay according to the invention and having the characterizing features of patent claim 1 has the advantage that additional space is no longer required in the motor vehicle for the auxiliary relay, since the latter is arranged inside the contact space of the engaging relay, and since the mounting length of the engaging relay can be maintained. Moreover, this solution renders it possible to connect the auxiliary relay permanently in the engaging relay in such a way that outwardly, as before, only the two terminal studs of the switching contacts of the engaging relay for the main circuit of the starter device is present, in common with a terminal for the conductive connection to the starter switch. All the terminals are located, as before, in a readily accessible fashion on the end face of the switch cover of the engaging relay.

SUMMARY OF THE INVENTION

Accordingly, it is an object of the present invention to provide an engaging relay for starting devices, which avoids the disadvantages of the prior art.

In keeping with these objects and with others which will become apparent hereinafter, one feature of the present invention resides, briefly stated, in an engaging relay in which by switching on a pull-in winding and a holding winding of the engaging relay an armature on the one hand engages, via a linkage, a pinion of the starter device in a gear ring of the internal combustion engine, and on the other hand switches on the main circuit of the starter motor of the starter device via a contact bridge which cooperates with switching contacts of the engaging relay the contact bridge being arranged at the end of a switching bolt which is to be actuated by the armature and it being the case that at lest the pull-in winding is to be switched on by relay contacts of an auxiliary relay wherein the auxiliary relay is arranged in a contact space which is closed to the outside by a switch cover into which the switching bolt projects and which is closed toward the pull-in and holding windings by a magnet core, the switching bolt projects through the magnet core and through the auxiliary relay, one end of the relay winding of the auxiliary relay is connected in the contact space to the magnet core, which conducts frame potential, of the engaging relay, and the other end of the relay winding is contacted to a connecting part fastened in the switch cover.

With the engaging relay designed in accordance with the present invention, it has the advantage that additional space is no longer required in the motor vehicle for the auxiliary relay, is particularly advantageous to connect the relay contact, constructed as a make contact, of the auxiliary relay on the one hand to the switching contact used for connecting the motor vehicle battery (terminal 30), and on the other hand to the windings of the engaging relay inside the contact space. A spatially favorable arrangement of the auxiliary relay is possible owing to the fact that it is arranged below the contact bridge of the main circuit on the magnet core in concentric fashion around the switching bolt, which is actuated by the armature of the engaging relay.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 shows a section, represented enlarged, of the relay from FIG. 1 with the auxiliary relay in longitudinal section;

FIG. 3 shows a cross section along the line III—III from FIG. 1;

DESCRIPTION OF THE PREFERRED EMBODIMENTS

Figure 1:
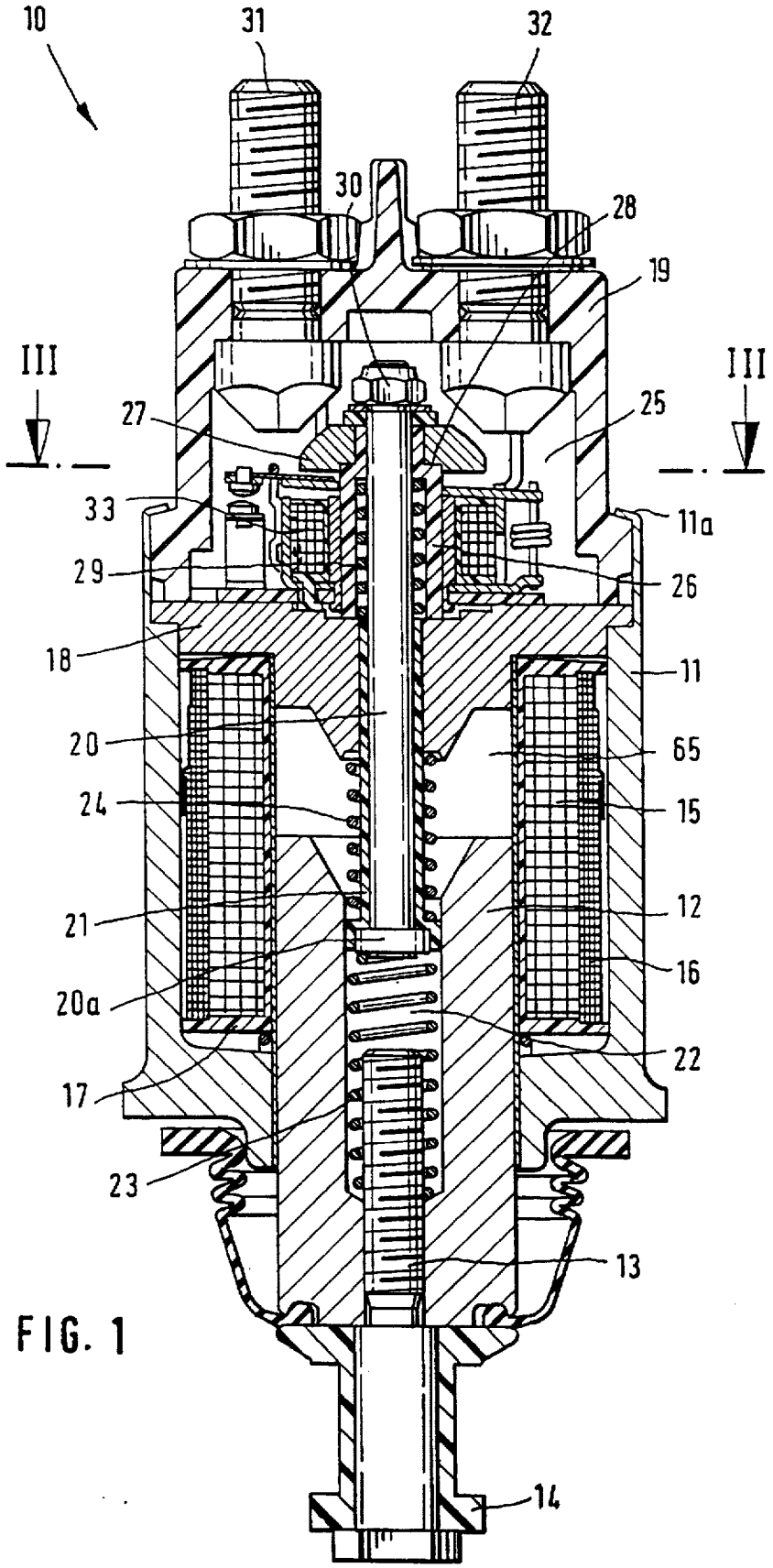
FIG. 1 shows a longitudinal section of an engaging relay having an integrated auxiliary relay according to the invention.

An engaging relay according to the invention for the starter device of an internal combustion engine is denoted by 10 in FIG. 1. Arranged in an axially displaceable fashion in a magnetically conductive, pot-shaped housing 11 of the engaging relay 10 is a cylindrical armature 12 into whose lower end a screw 13 having an insulating bushing 14 is screwed, via which in a manner known per se via a claw-shaped lever linkage, the armature engages a pinion of the starter device in a gear ring of the internal combustion engine, or disengages it from said gear ring. The armature 12 is rounded at its upper section concentrically by a pull-in winding 15 and a holding winding 16, which are seated in the housing 11 on a coil former 17. Inserted into the relay housing 11 above the coil former 17 is a magnet core 18 which is permanently clinched on the housing 11 by the upper housing edge 11*a* via a spring plate together with a switch cover 19 of the engaging relay 10. A switching bolt 20 on which a spacer bushing 21 is arranged is guided in a central bore of the magnet core 18, the head 20*a* of the switching bolt 20 dipping into a central blind hole 22 of the armature 12. In this arrangement, the head 20*a* of the switching bolt is on the one hand subjected on its underside to a compression spring 23 inserted in the blind hole 22, and on the other hand held in the rest position represented by a further helical compression spring 24 inserted between the armature 12 and the head of the switching bolt 20. The upper end of the switching bolt 20 projects above the armature 12 into a contact space 25 of the switch cover 19. The upper section of the switching bolt 20 carries an insulating bushing 26 on which a contact bridge 27 is mounted at the front. The contact bridge 27 rests on an annular shoulder 28 of the insulating bushing 26, which is expanded concentrically in the lower section. Inserted as contact pressure spring 29 into the annular gap thereby formed between the switching bolt 20 and insulating bushing 26 is a further helical compression spring which is supported on the one hand against the spacer bushing 21, and on the other hand against the annular shoulder 28 of the insulating bushing 26. The insulating bushing 26 and contact bridge 27 are secured in an electrically insulated fashion on the switching bolt 20 by means of a nut 30 screwed onto the upper end of the switching bolt 20. The contact bridge 27 cooperates with two switching contacts of the engaging relay, which are inserted as contact screws 31, 32 at a distance from one another in a known way into the end face of the switch cover 19.

Arranged below the contact bridge 27 on the magnet core 18 is an auxiliary relay 33 whose relay contacts switch on the windings 15 and 16 of the engaging relay 10. The auxiliary relay 33 is arranged concentrically around the switching bolt 20 to be actuated by the armature 12.

FIGS. 2 and 3 show in an enlarged representation the arrangement and design of the auxiliary relay 33 in the contact space 25 of the engaging relay 10. According to the figures, the auxiliary relay 33 is pushed with its relay winding 34 onto a magnet core sleeve 35 which is fastened concentrically around the expanded shoulder of the insulating bushing 26 on the end of the switching bolt 20. The magnet core sleeve 35 is fastened in this case in a corresponding hole in the yoke of a U-shaped magnet bracket 37 which embraces the relay winding 34. Mounted on one end 38 of the limb of the magnet bracket 37 is a clapper-type armature 39 which is acted upon at its projecting end by a resetting spring 40 suspended on the magnet bracket 37. The free end of the clapper-type armature 39 carries a contact spring 41 at whose free end two contacts 42 arranged next to one another are permanently riveted to a busbar 43 in order to form a contact bridge 44. This contact bridge 44 cooperates with two fixed relay contacts 45, 46 arranged thereunder at a distance. Permanently screwed by means of two screws 48 on the end face, bounding the contact space 25, of the magnet core 18 is an insulating plate 47 on which there are fastened the magnet bracket 37 with the magnet core sleeve 35 and the relay winding 34 with its winding support 49 in which a plurality of rivet pins 50 integrally formed on the underside of the winding support 49 are permanently riveted in corresponding cutouts in the magnet bracket 37 and the insulating plate 47. The clapper-type armature 39 is held in its represented rest position by means of a wire clip 51 suspended on the magnet bracket 37. The insulating plate 47 further carries the two fixed relay contacts 45 and 46 in the region of two conductor tracks 52 and 53 provided as linings on the insulating plate 47. In this case, the conductor tracks 52 and 53 can also, if required, be replaced by busbars which are then expediently fastened, constructed in one piece with the associated relay contact 45 and 46, on the insulating plate 47.

Figure 4:
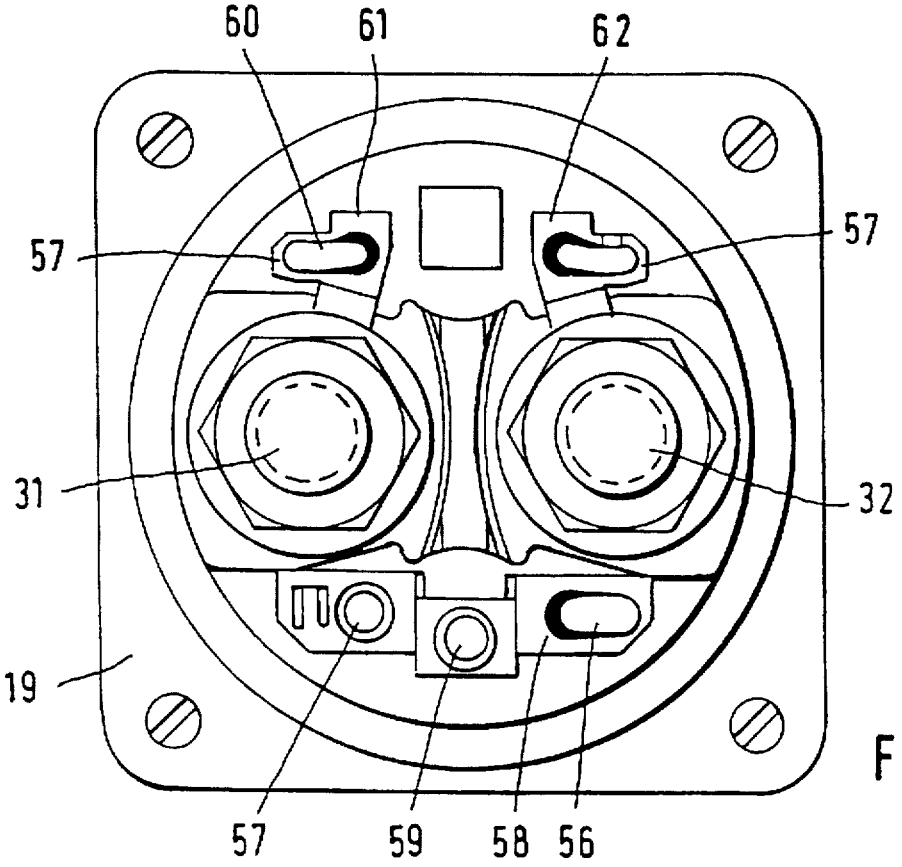
FIG. 4 shows a top view of the engaging relay from FIG. 1.

One end 34*a* of the relay winding 34 of the auxiliary relay 33 is electrically connected to the magnet core 18, which conducts frame potential, of the engaging relay 10, by providing that this end is soldered or welded to a terminal lug 54 which is permanently screwed by means of the screw 48 for fastening the insulating plate 47 on the magnet core 18 in the contact space 25. The other end 34*b* of the relay winding 34 is soldered to a terminal region 55 of the insulating plate 47 to which a connecting conductor 56 which leads to the switch cover 19 is permanently soldered. It may be seen in the top view of the switch cover 19 in accordance with FIG. 4 that above and below the two contact studs 31 and 32 hollow rivets 57 are respectively riveted into corresponding bores in the switch cover 19 through which connecting conductors are led to the outside from the contact space 25 and are soldered there to connecting parts. Thus, the connecting conductor 56 for connecting the relay winding 34 of the auxiliary relay 33 is soldered outside on the switch cover 19 to a terminal lug 58 which is to be connected to a terminal screw 59 as terminal 50 for connecting the control line coming from the starter switch of the internal combustion engine.

The relay contacts 45 and 46, which operate as make contacts are respectively connected via one of the conductor tracks 52 and 53 of the insulating plate 47. One fixed relay contact 45 is contacted in this case via the conductor track 52 to a connecting conductor 60 and the latter is contacted to a terminal lug 61 which is permanently screwed on the contact stud 31 in the main starter circuit which is connected as terminal 30 to the positive terminal of the motor vehicle battery. The other relay contact 46 is connected via the conductor track 53 inside the contact space 25 to one end 15*a* of the pull-in winding 15 and one end 16*a* of the holding winding 16, which are led through a corresponding cutout 62 in the magnet core 18 to the conductor track 53 and soldered on there. The other end 15*b* of the pull-in winding 15 is likewise soldered through the contact space 25 and one of the rivets 57 onto a terminal lug 62 which is screwed to the second contact stud 32 outside on the switch cover 19, on which the connection (terminal 45) leading to the starter motor is screwed. The other terminal 16b of the holding winding 16 is, by contrast, permanently welded directly on the magnet core 18, which is at frame potential.

Figure 5:
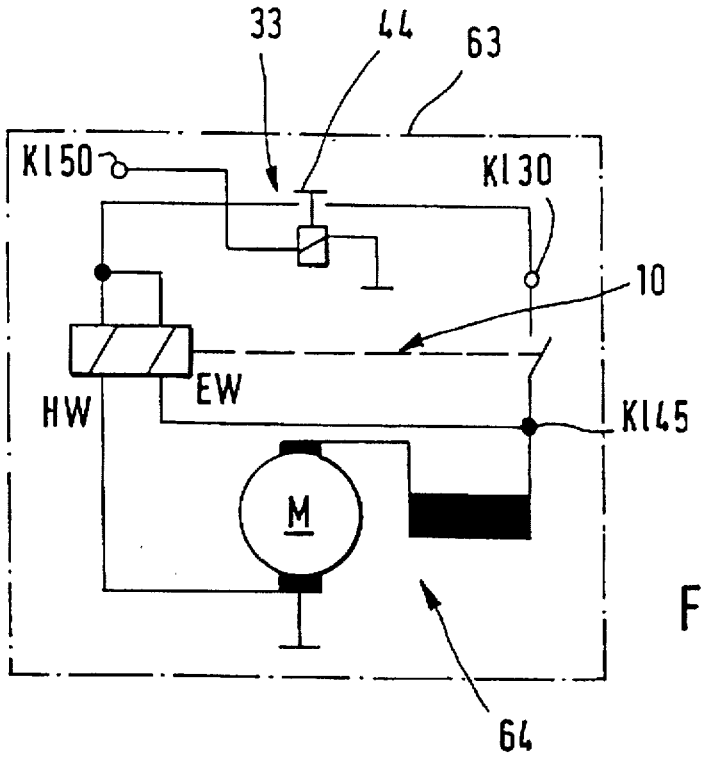
FIG. 5 shows the connection circuit of the engaging relay according to FIG. 1.

FIG. 5 shows the electric circuit of the overall starter device 63 having the starter motor 64 and the engaging relay 10. It is to be seen from this that the auxiliary relay 33, integrated in the engaging relay 10, is excited upon application of a voltage to the terminal 50, and that the relay contacts 45, 46 are closed via the contact bridge 44. As a result, the battery voltage reaches the pull-in winding 15 and holding winding 16 from the terminal 30 via the auxiliary relay 33, the holding winding 16 being connected directly to frame and the pull-in winding 15 being connected to frame via the starter motor 64. The engaging relay 10 is switched on owing to the fact that the magnetic energy building up in the working air gap 65 between the magnet core 18 and armature 12 pulls in armature 12 against the restoring force of the spring 24, and thus firstly advances the starter pinion via a lever linkage. Moreover, during the pulling-in operation the switching bolt 20 is pressed high in the last stroke segment by the screw 23 against the force of the spring 34, with the result that the contact bridge 27 bears with the force of the contact pressure spring 29 against the switching contacts of the contact studs 31 and 32 and thus closes the main circuit of the starter device 63. The pinion which has meanwhile been engaged is now driven by the starter motor 64 and the internal combustion engine is thereby started. Moreover, by closing the main circuit the pull-in winding 15, which is connected in parallel with the contact bolts 31 and 32, is bridged and thus disconnected, with the result that the engaging relay 10 still remains actuated by the holding winding 16. As soon as the starter switch is opened at the terminal 50, the auxiliary relay 33 drops out again and now also interrupts the circuit for the holding winding 16. The armature 12 now moves again into the neutral position and the main circuit of the starter device is interrupted.

FIGS. 6 to 9 show a second exemplary embodiment of the invention, identical parts from the first exemplary embodiment being provided with identical reference numerals. By contrast with the first exemplary embodiment, here the auxiliary relay 33 in the contact space 25 of the engaging relay 10 with the winding support 49 of the relay winding 34 is largely let into the magnet core 13, in order to keep the overall length of the engaging relay 70 as short as possible. In addition, instead of a clapper-type armature a soft magnetic leaf spring 71 is provided, one end of which is fastened on the armature 12 in an electrically insulated fashion by means of a screw 72, and the other, free end of which carries a first relay contact 73 which cooperates as a make contact with a second relay contact 74 inserted in an insulated fashion in the armature 12. The central section of the 34, leaf spring 71 is situated above the relay winding with the result that the leaf spring 71 closes the relay contacts 73, 74 when the auxiliary relay is excited. It is to be seen from the circuit diagram of the starter device in FIG. 9 that the fixed relay contact 74 of the auxiliary relay 33 is connected via a conductor 75 to the contact stud 31 as terminal 30, and that the other relay contact 73 is contacted via the leaf spring 71 to the screw 72 by means of an end of the pull-in winding 15. The relay winding 34 is contacted by means of the end not connected to frame together with an end of the holding winding 16 via a further conductor 76 to a terminal lug 58 by means of a terminal screw 59 on the switch cover 19, which forms the terminal 50. The other ends of the pull-in winding 15 and holding winding 16 are connected here to frame by being welded on the armature 18 which conducts frame potential.

Figure 6:
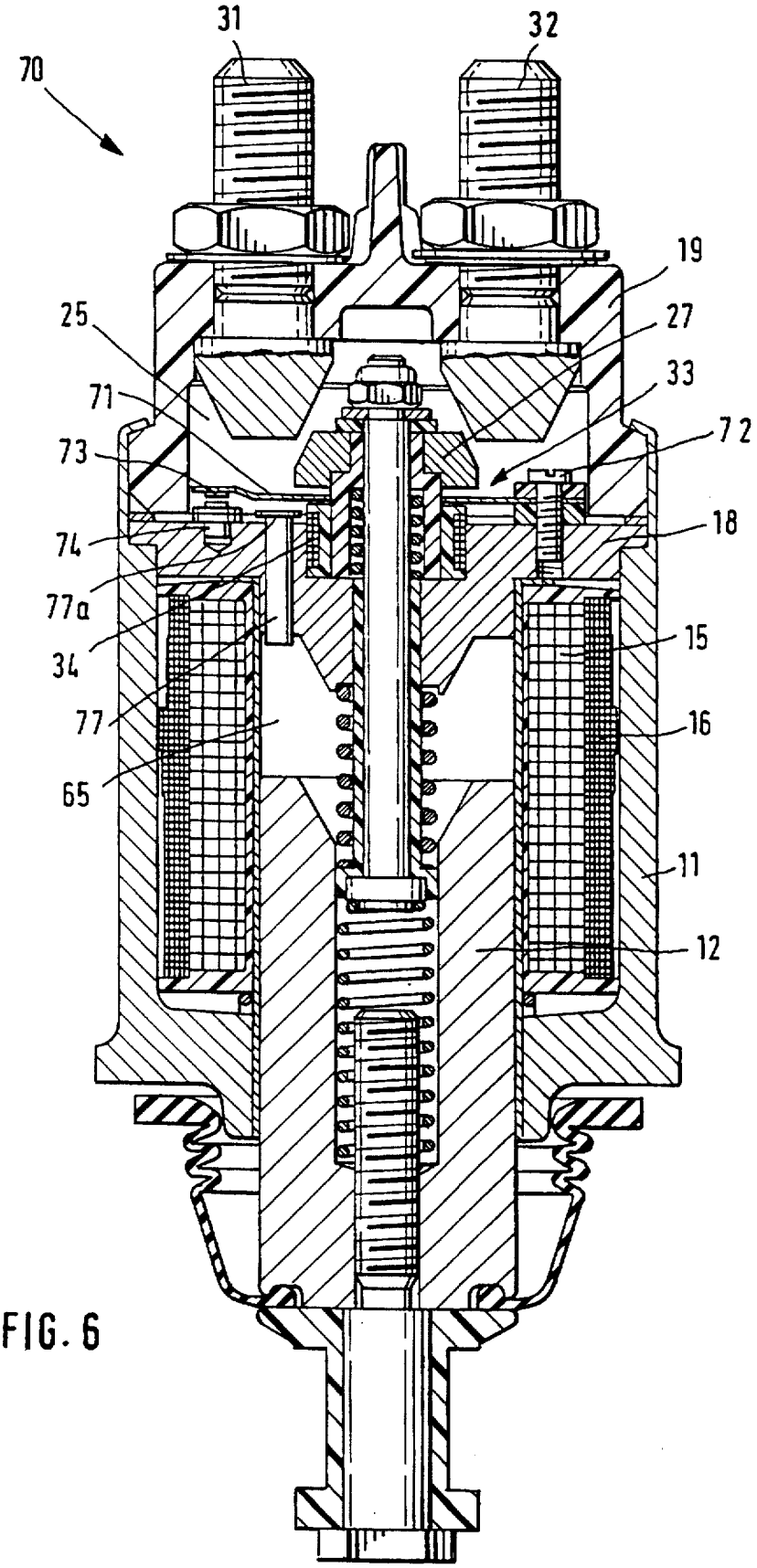
FIG. 6 shows a further exemplary embodiment of an engaging relay according to the invention having an integrated auxiliary relay in open position.
Figure 7:
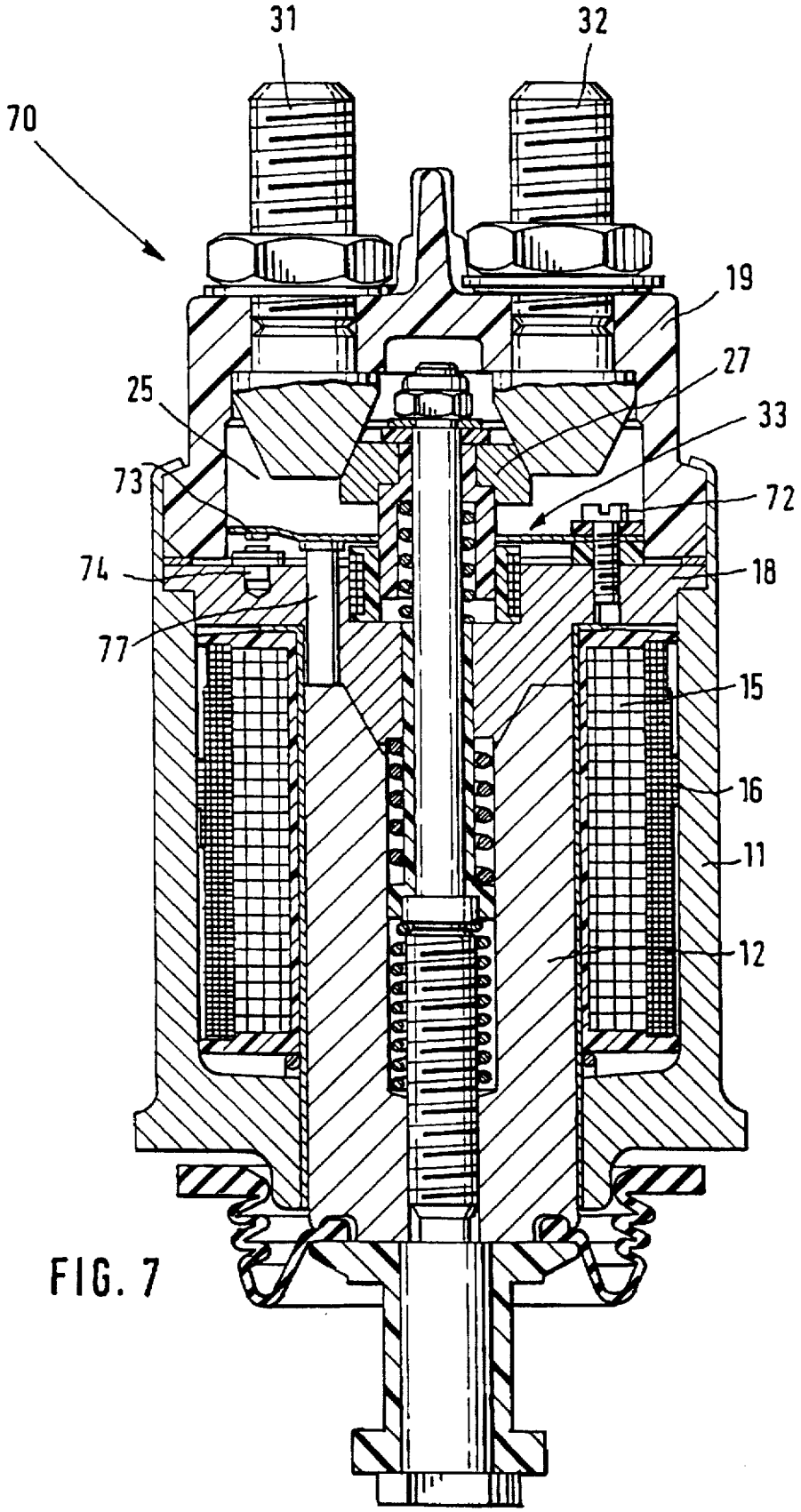
FIG. 7 shows the same engaging relay in operating position.
Figure 8:
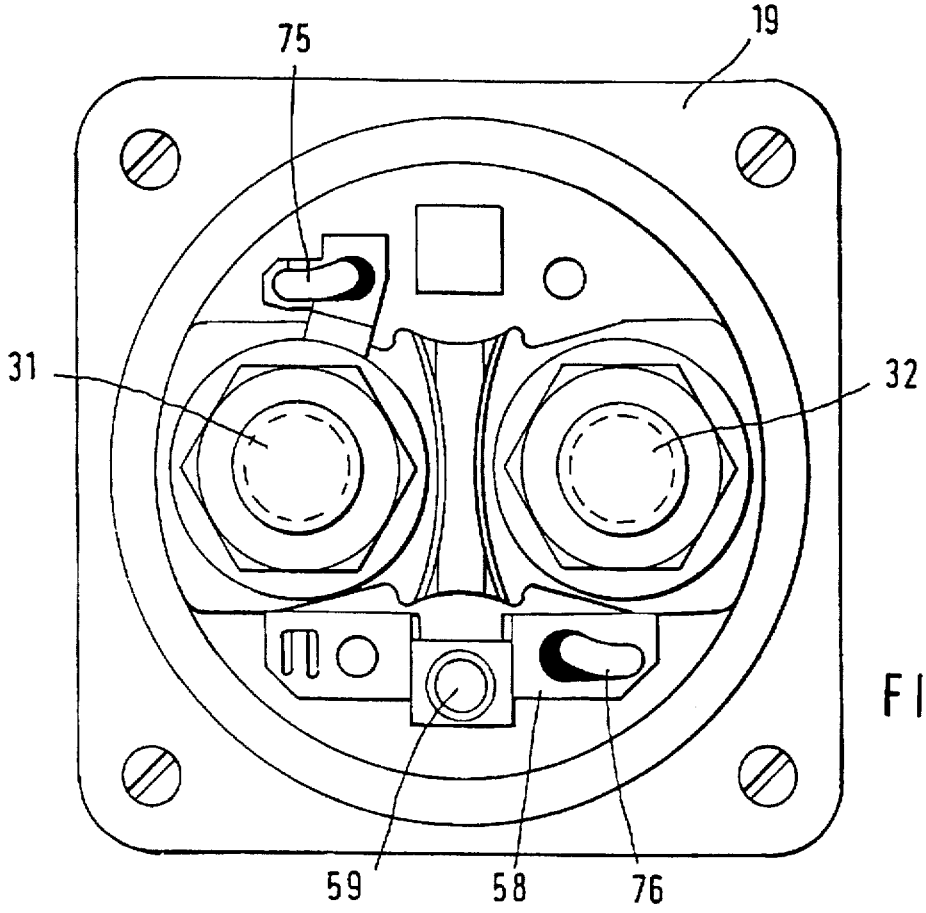
FIG. 8 shows the top view of this engaging relay.
Figure 9:
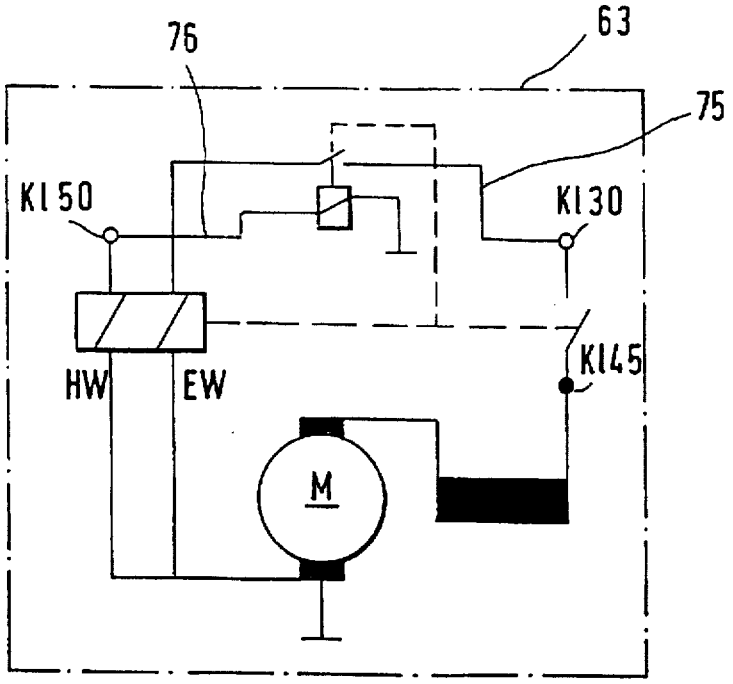
FIG. 9 shows the connection circuit.

It is provided in the case of the pull-in relay 70 that the latter positively opens the relay contacts 73 and 74 of the auxiliary relay 33 in the switched-on state, in order thereby to switch off the pull-in winding 15. For this purpose, there is mounted in the magnet core 18 a pin 77 which can be displaced in the axial direction of the armature 12 and projects into the working air gap 65 between the magnet core 18 and armature 12, and bears with its head 77a in the contact space 25 against the magnet core 18 when the engaging relay in accordance with FIG. 6 is switched off. When the engaging relay 70 in accordance with FIG. 7 is switched on, the effect of the last stroke segment of the armature 12 is to press the pin 77 with its head 77a in an electrically insulated fashion against the leaf spring 71 of the auxiliary relay 33, with the result that the relay contacts 73 and 74 are positively opened.

It will be understood that each of the elements described above, or two or more together, may also find a useful application in other types of constructions differing from the types described above.

While the invention has been illustrated and described as embodied in an engaging relay for starter devices, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patents is set forth in the appended claims:

1. An engaging relay for starter devices of internal combustion engines, comprising a pull-in winding and a holding winding; switching contacts; a contact bridge which cooperates with said switching contacts; an armature; a linkage arranged so that by switching on said pull-in winding and said holding winding said armature engages via said linkage a pinion of a starter device in a gear ring of an internal combustion engine, and switches on a main circuit of a starter motor of the starter device via said contact bridge which cooperates with said switching contacts; a switching bolt actuated by said armature and having an end at which said contact bridge is arranged; an auxiliary relay being arranged in said contact space and having a relay contacts such that at least said pull-in winding is switched by said relay contacts; means forming a contact space covered by a switch cover having a connecting part and arranged so that said switching bolt projects into said contact space; a magnet core which closes said contact space toward said pull-in and said holding windings, said switching bolt projecting through said magnet core and through said auxiliary relay, said auxiliary relay being arranged in said contact space and having a relay winding with one end connected in said contact space to said magnet core which conducts frame potential and with another end is contacted to said connecting part fastened in said switch cover.

2. An engaging relay as defined in claim 1, wherein said auxiliary relay is permanently arranged on said magnet core.

3. An engaging relay as defined in claim 1, wherein said auxiliary relay is arranged below said contact bridge on said magnet core concentrically around said switching bolt which is actuated by said armature.

4. An engaging relay as defined in claim 1; and further comprising an insulating bushing fastened on an end of said switching bolt so as to accommodate said contact bridge; a magnet core sleeve; and a winding support arranged so that said relay winding of said auxiliary relay is pushed with said winding support onto said magnet core sleeve.

5. An engaging relay for starter devices of internal combustion engines, comprising a pull-in winding and a holding winding; switching contacts; a contact bridge which cooperates with said switching contacts; an armature; a linkage arranged so that by switching on said pull-in winding and said holding winding said armature engages via said linkage a pinion of a starter device in a gear ring of an internal combustion engine, and switches on a main circuit of a starter motor of the starter device via said contact bridge which cooperates with said switching contacts; a switching bolt actuated by said armature and having an end at which said contact bridge is arranged; an auxiliary relay having a relay contacts such that at least said pull-in winding is switched by said relay contacts; means forming a contact space covered by a switch cover having a connecting part and arranged so that said switching bolt projects into said contact space; a magnet core which closes said contact space toward said pull-in and said holding windings, said switching bolt projecting through said magnet core and through said auxiliary relay, said auxiliary relay being arranged in said contact space and having a relay winding with one end connected in said contact space to said magnet core which conducts frame potential and with another end is contacted to said connecting part fastened in said switch cover, an insulating bushing fastened on an end of said switching bolt so as to accommodate said contact bridge; a magnet core sleeve; a winding support arranged so that said relay winding of said auxiliary relay is pushed with said winding support onto said magnet core sleeve; and a U-shaped magnet bracket accommodating said relay winding and having a yoke provided with a hole and a limb, said magnet core sleeve being fastened in said hole of said yoke of said magnet bracket, said limb having one end supporting a clapper-type armature which has a resetting spring and a free end having a contact spring with a contact bridge of said auxiliary relay which cooperates with said relay contacts.

6. An engaging relay as defined in claim 5, wherein said insulating plate is provided with at least one conductor track which is connected to one of said relay contacts of said auxiliary relay and to at least one end of said pull-in winding.

7. An engaging relay as defined in claim 6, wherein another of said relay contacts and said auxiliary relay is connected to one of said switching contacts so that starting from said conductor track of said insulating plate a conductor is led through said switch cover; and a terminal lug which is permanently screwed from outside on said one switching contact and contacted with said conductor.

8. An engaging relay as defined in claim 1; and further comprising a pin mounted in said magnet core and displaced in an axial direction of said armature, said pin projecting into a working air gap between said magnet core and said armature and opening said relay contacts of said auxiliary relay when said armature is pulled in.

9. An engaging relay for starter devices of internal combustion engines, comprising a pull-in winding and a holding winding; switching contacts; a contact bridge which cooperates with said switching contacts; an armature; a linkage arranged so that by switching on said pull-in winding and said holding winding said armature engages via said linkage a pinion of a starter device in a gear ring of an internal combustion engine, and switches on a main circuit of a starter motor of the starter device via said contact bridge which cooperates with said switching contacts; a switching bolt actuated by said armature and having an end at which said contact bridge is arranged; an auxiliary relay having a relay contacts such that at least said pull-in winding is switched by said relay contacts; means forming a contact space covered by a switch cover having a connecting part and arranged so that said switching bolt projects into said contact space; a magnet core which closes said contact space toward said pull-in and said holding windings, said switching bolt projecting through said magnet core and through said auxiliary relay, said auxiliary relay being arranged in said contact space and having a relay winding with one end connected in said contact space to said magnet core which conducts frame potential and with another end is contacted to said connecting part fastened in said switch cover, said relay contacts being formed as make contacts, said auxiliary relay being connected to one of said switching contacts for connecting a motor vehicle battery and also connected to said pull-in winding and said contact space.

10. An engaging relay as defined in claim 5; and further comprising a winding support, said magnet core of said engaging relay carrying toward said contact space an insulating plate on which said magnet bracket with said magnet core sleeve and said winding support with said relay winding and said relay contacts are fastened.

11. An engaging relay for starter devices of internal combustion engines, comprising a pull-in winding and a holding winding; switching contacts; a contact bridge which cooperates with said switching contacts; an armature; a linkage arranged so that by switching on said pull-in winding and said holding winding said armature engages via said linkage a pinion of a starter device in a gear ring of an internal combustion engine, and switches on a main circuit of a starter motor of the starter device via said contact bridge which cooperates with said switching contacts; a switching bolt actuated by said armature and having an end at which said contact bridge is arranged; an auxiliary relay having a relay contacts such that at least said pull-in winding is switched by said relay contacts; means forming a contact space covered by a switch cover having a connecting part and arranged so that said switching bolt projects into said contact space; a magnet core which closes said contact space toward said pull-in and said holding windings, said switching bolt projecting through said magnet core and through said auxiliary relay, said auxiliary relay being arranged in said contact space and having a relay winding with one end connected in said contact space to said magnet core which conducts frame potential and with another end is contacted to said connecting part fastened in said switch cover, said pull-in winding and said holding winding each having one end connected to one of said relay contacts of said auxiliary relay in said contact space, said pull-in winding having another end connected to one of said switching contacts leading to the starter motor and said holding winding having another end connected to said magnet core which conducts frame potential.

* * * * *